United States Patent [19]

Saliba

[11] Patent Number: 4,913,074

[45] Date of Patent: Apr. 3, 1990

[54] METHOD OF MANUFACTURING REINFORCED LEATHER PORTFOLIO

[76] Inventor: Frank Saliba, 115 W. 30th St., New York, N.Y. 10001

[21] Appl. No.: 203,925

[22] Filed: Jun. 8, 1988

Related U.S. Application Data

[62] Division of Ser. No. 93,554, Sep. 8, 1987, Pat. No. 4,830,153.

[51] Int. Cl.[4] ..... A45G 13/36

[52] U.S. Cl. ..... 112/262.1; 190/125; 190/127; 190/903

[58] Field of Search ..... 112/262.1; 190/900, 190/901, 902, 903, 125, 127

[56] References Cited

U.S. PATENT DOCUMENTS 4,433,760 2/1984 Pelavin ..... 190/127 X

FOREIGN PATENT DOCUMENTS 3344409 6/1985 Fed. Rep. of Germany ..... 190/902

863383 3/1961 United Kingdom ..... 190/100

*Primary Examiner*—William Price

*Attorney, Agent, or Firm*—Leitner, Greene & Christensen

[57] ABSTRACT

The invention relates to a method of manufacturing reinforced leather portfolio having wide opening top and concealed name tag, the wide opening top of the portfolio is provided by a novel subassembly of sides and bottom in which the top of the side portions of the subassembly is from 10 to 25% wider, preferably 20% wider than the bottom which provides much easier access to removing the contents of the center section of the portfolio. The two top-widened sides and the bottom of the subassembly comprise stitched together sheets of leather which are sewed to the envelope side panels of the portfolio and these sides and bottom panels are reinforced in an entirely new location at the center by a separate strap of continuous length going from the top of one side around the bottom and up the other side and which is stitched to provide a central load carrying strap secured to the sides and bottom which prevents tearing away from the envelope panels to which they are stitched. The inner center top portion of one envelope flap is provided with a strap which bends over the top of the envelope flap and is secured to a snap fastener member by means of a button on the inside of the strap. Above the button of this strap inside of the flap formed by the folding of a strap a compartment is provided for a concealed identification tag.

6 Claims, 3 Drawing Sheets

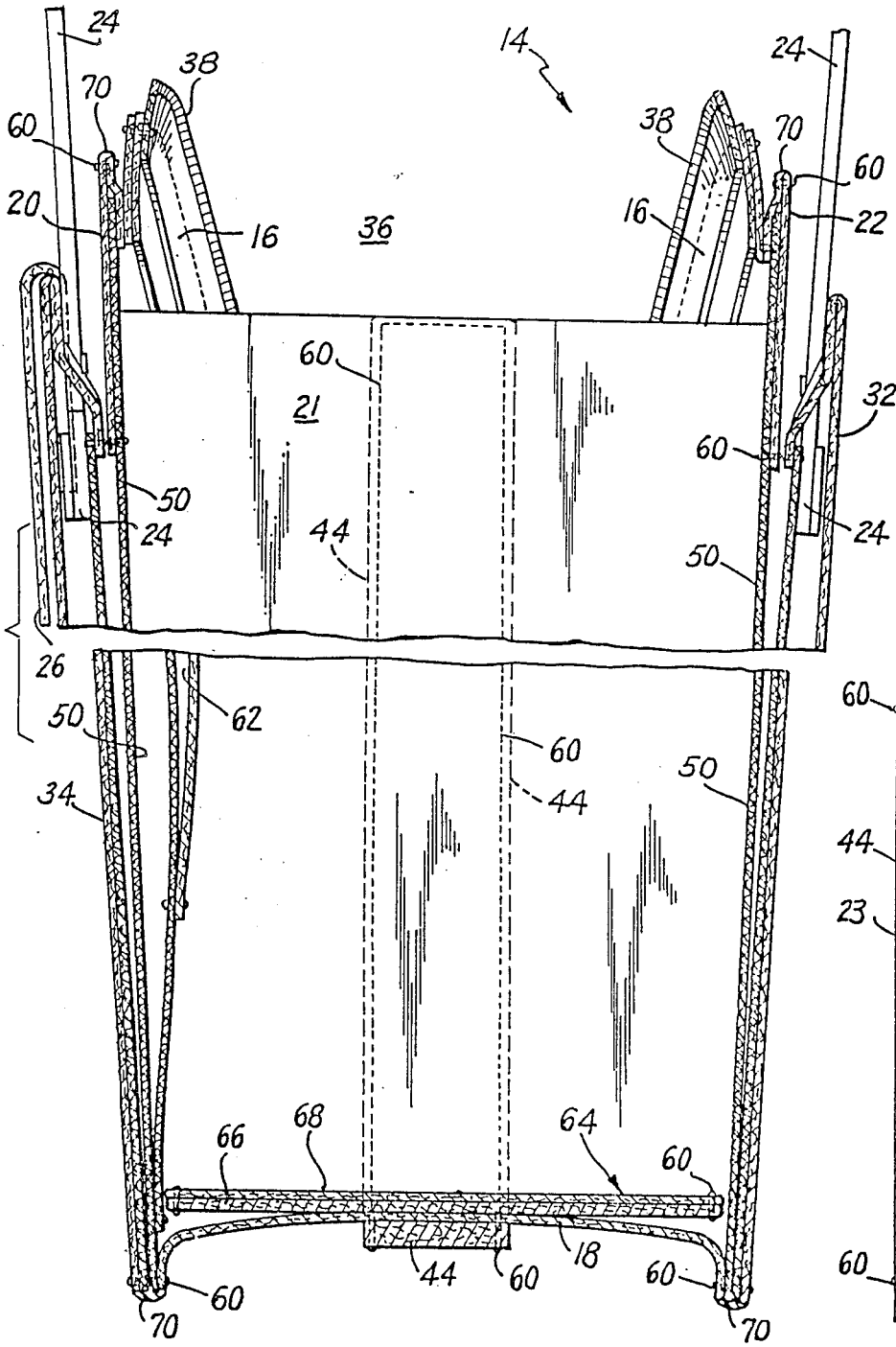
Fig. 8
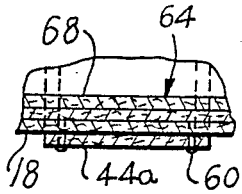
Fig. 8A
Fig. 9
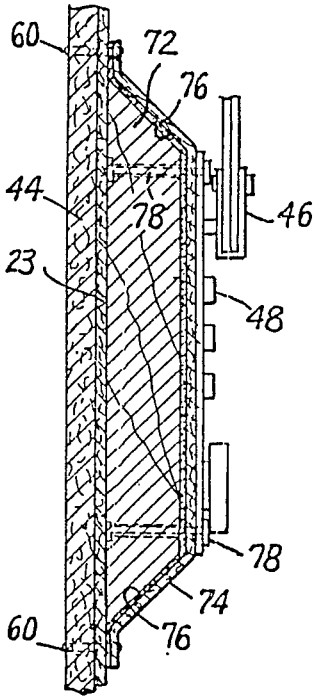
Fig. 11
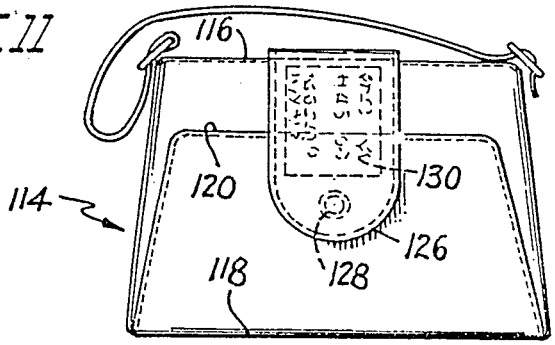
Fig. 10
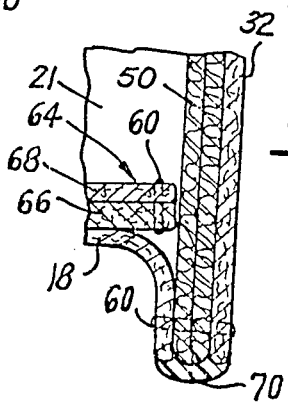

METHOD OF MANUFACTURING REINFORCED LEATHER PORTFOLIO

This is a division of application Ser. No. 093,554, filed Sept. 8, 1987 and now U.S. Pat. No. 4,830,153.

CROSS REFERENCE TO RELATED APPLICATIONS

Frank Saliba, Ser. No. 06/859,483, filed May 5, 1986, entitled "Handle and Panel Assembly in Zipper Closed Portfolio" issued as U.S. Pat. No. 4,714,143, granted Dec. 22, 1987.

Frank Saliba, Ser. No. 06/859,484, filed May 5, 1986, entitled "Hasp Lock, Zipper and Cover Assembly for Portfolio".

BACKGROUND OF THE INVENTION

1. Field of the Invention

This invention is in the field of sewing of leather portfolios and particularly leather lined portfolios in which the center pocket which is formed by attaching together side and bottom pieces by sewing at their edges in overlapping relation are reinforced by an outside strap and in which the top of the side pieces are substantially wider than the bottom to thereby permit a wider opening of the center section when the center section is opened for withdrawal of the portfolio contents.

This invention is further related to methods for attaching slide fastener elements to the side and top inner portions of the center pocket whereby the center pocket can be easily opened and closed to expose and remove the contents thereof.

This invention is further related to methods for joining leather sheets or webs of the outer panel of a portfolio or handbag together by stitching to a tab fitted with a fastener whereby a concealed identification strap is enclosed within a pocket is provided in said tab and is adapted to be snap fastened and unfastened to be exposed for identifying the ownership of the portfolio or pocketbook. The construction of the tab encasing the identification strap is part of the inner construction of the tab.

The invention is further related to the method of sewing an external reinforcing strap along the bottom and ides of a portfolio and said reinforcing strap is provided in a substantially greater thickness than the thickness of the sides and bottom to which it is attached, the stitching locating the strap at the center of the sides and the center of the bottom piece thereby accommodating substantially the entire weight of the contents of the center pocket on the strap and at the same time relieving the pulling strains which are ordinarily exerted by the load in the center pocket pulling the bottom away from the sides to which the bottom is sewn.

The invention is also related to the provision of a novel concealed identification tab which will aid the owner of a portfolio or a pocketbook to identify the owner when the portfolio is checked in a baggage station, check room or the like, or when the pocketbook is lost and which is adapted for pocketbooks having a center pocket construction.

2. Description of the Prior Art

In the field of identification elements for handbags, portfolios, golf bags and the like, numerous tags have been provided to establish the identity of the owner so that the misplacement of the bag may be easily corrected and the checking of the bag may be facilitated when the bag is retrieved. It is a common practice for children going to camp having name tags sewn on their clothing, particularly undergarments, shirts, socks and the like. Cameras and binoculars are commonly provided with metal name tags which are embossed at the time of purchase by the retailer. Ladies handbags have become so stylized that they are today recognized by the logo of the manufacturer which is generally placed upon a flap which serves to close the pocketbook from its point of attachment in the middle compartment of the handbag. Examples of logos which distinguish the goods by identifying the manufacturer are handbags made by Aigner, Liz Claiborne, Gucci, Louis Vuitton, and Coach. In Coach handbags many are identified on an inside pocket which is different from the identification on an outer flap connected to the inside pocket and strapped to the outer panel. In short, the Coach line of handbag can be used by the purchaser for reordering to relate to a specific model and style number. None of these types of commercial bags and briefcases have provided a concealed flap to carry identification of the owner on the inside of the flap and in a pocket which is not exposed because the flap is snapped shut in a location on one side of the portfolio between the sides of one of the handles and at the top thereof.

Identification tags are commonly exposed openly to view near the handle of a valise or luggage and examples are found in Newson, U.S. Pat. No. 867,403 which shows tag 9 in FIG. 3 directly below the handle and Schweitzer, et al, U.S. Pat. No. 906,568, which shows the tab serving as a logo and similar to the Hartman logo on the Hartman portfolio manufactured by the Hartman Company of Lebanon, Tenn.

The concept in the present invention is to separate the logo or trade information of the manufacturer from the concealed identification of the owner. One ordinarily does not look for the manufacturer's identification for a tag that could simultaneously provide in a part thereof the identification of the owner. This is a novel concept which is applicable not only to leather portfolios of high quality manufactured by the present inventor but also to high quality leather handbags.

It is very common to provide identification tags which are presented in frame constructions highly visible to anyone seeing the container, baggage, or the like. Examples are found in Goewey, U.S. Pat. Nos. 1,512,332, Brown, 1,610,354, Braunstein, 1,767,573 and in garment bags such as Walters, U.S. Pat. No. 3,999,639. Also baggage tags are commonly used to aid in reclining baggage which has been checked, from tags being provided by the travel agency or airlines or the like, others by the manufacturer and examples are found in Currie, U.S. Pat. Nos. 1,211,681, Anania, 2,768,458 and Von Meyer, 3,417,496. An airport baggage tag is shown in Christiansen, U.S. Pat. No. 3,808,718. Name plates are commonly used in luggage as exemplified in Dorsen et al, U.S. Pat. Nos. 4,177,587 and Machler, 4,199,045. However, name plates or use of initials are generally provided by embossing or scribing metal used as an ornament with hard sides luggage. The present construction is significantly different in its application in leather portfolios having a central pocket and to ladies leather handbags having a center pocket.

It is well known to strengthen a seam formed by sewing together pieces of leather by interposing a welt strip between the overlapping edges of the leather sheets such as shown in the patent to Glanville, U.S.

Pat. No. 246,948 patented Sept. 13, 1981. The welt strip which is interposed is positioned so that the edges project beyond the overlapping edges upon opposite sides of the leather sheet and the strap is sewn by passing a line of stitches through the overlapping portions of the stock through the middle of the welt strip. The welt strip is generally positioned in a shoe at a position where the sole is stitched to the upper but I am not aware that a reinforcing strip has ever been used heretofore on the outside of a load carrying sack or soft pouch or soft luggage for the purposes of reinforcing the sewn bag or soft portfolio and prevent the stitches from being separated due to the weight of the load.

I am aware of seams in boots and shoes which are made by sewing two pieces of leather together as shown in the patent to Farnsworth, U.S. Pat. No. 126,537, granted May 7, 1982 in which two pieces of leather are connected together before the outer strip is attached after shaving down the edges of the leather so that the dressed surfaces of the leather will be positioned face to face. In the Farnsworth patent a narrow strip is cut and positioned along the length of the sewn seam and is sufficiently broad to lap a short distance over the two united parts. The present invention is different from the seams in the Farnsworth boot or shoe by being positioned at about the middle and transversely of the bottom and side parts which are sewn together in a manner such that the reinforcing strip of the present invention is provided along the center and side portions of the bag solely for the purpose of absorbing the strains of the load against the bag and away from the seam of the parts which are sewn together.

I am also aware of methods of manufacturing luggage covers for hard luggage in which corner straps are provided at the top and sides of the hard luggage to produce scuff proof edges of the luggage as shown in the Davis U.S. Pat. No. 4,337,853, granted July 6, 1982. However, this scuff proof edge structure provided in Davis is not comparable to the reinforcing strap which is sewn in a direction transverse to the sewn seams of the top and side leather pieces forming the top and sides of the center compartment of the portfolio.

I am also aware of reinforcing formed of metal strip valances particularly those made of aluminum or other soft metals to the opposing edges of hard luggage shells as disclosed in Koffler, U.S. Pat. No. 3,468,274 in which the metal valance is used as edging for the luggage shell.

Further, I am aware of Davis, U.S. Pat. No. 4,350,546 which provides a special overlapping edge seam for the edges of hard luggage and which is designed to withstand scuffing forces which the patentee believes causes the seams to tear in such luggage. However, the present reinforcing strap is an entirely different load carrying relationship to the center compartment of soft luggage and is not suggested by this Davis patent.

Holtzman, U.S. Pat. No. 3,866,554 is the only patent found in the sewing art relating to soft side luggage in which a load bearing valance member is provided along a peripheral edge of luggage and this patent discloses a flexible edge bearing strip connected to the side wall panel of the soft side luggage wherein a bead providing a shoulder extending from the outer side of the luggage is inserted between the bottom and the side in stitched relationship to provide a reinforced side. The patentee recognizes the tendency of soft side luggage to split between the sides and the bottom and specifically at the edge of the load bearing valance and to overcome this tendency of the sides to be torn away from the bottom a totally different kind of edge reinforcement is constructed by stitching than is provided in the present invention.

SUMMARY OF THE INVENTION

The invention relates to improvements in the manufacture of leather portfolios in which a special reinforcement is provided at the sides of the portfolio and at the bottom, particularly for leather portfolios having rectangular side panels and a center compartment which is closed by slide fastener elements and preferably provided with a zipper cover and lock on the side as shown in my co-pending application Ser. No. 06/859,484 filed May 5, 1986, entitled "Hasp Lock, Zipper and Cover Assembly For Portfolio". The sides of the portfolio are provided by a novel sub-assembly of side panels and a bottom panel, the sub-assembly of the two sides and bottom being sewn together in overlapping relation so that the corners at the bottom of the portfolio lie within the sewn boundary and the tops of the sides being substantially wider than the bottom of the sides, that is to say from 10 to 25% wider at the top than at the bottom whereby the sewing of the side panels to the side elements and bottom element provides a wide opening top of the center compartment of the portfolio which is fitted with the hasp lock zipper and cover assembly as disclosed in my co-pending application Ser. No. 06/859,484.

The exterior of the two side and bottom panels are further reinforced with an exterior reinforcing strap which is at least as thick and not more than about two and one-half times as thick as the material of the sides and bottom of the portfolio. The reinforcing strap is sewn by a double line of stitching along the inner edges and is of a width which is sufficient to provide a significant stiffening of the side and bottom whereby a reinforcing result is achieved which combines the flexibility in the non-reinforced areas to permit the bottom and sides to accommodate various types of papers and files placed into the central compartment. The reinforcing strap is preferably in a single continuous length extending to the very top of the sides and along the entire bottom. As a result of the reinforcement and of the wider top of the two sides a substantially greater amount of files and other papers may be placed within the center compartment and the load carrying capacity of the portfolio is significantly increased up to 25% without unduly creasing the contents which are placed within the center compartment. In contrast to prior art teachings of application of edge bearing reinforcement elements such as in Holtzman U.S. Pat. No. 3,866,554 the present invention utilizes a strong substantially thick narrow strap along the middle of the side elements and bottom elements to provide reinforcement and the side panel construction is not modified at the bottom of each panel as in the aforesaid Holtzman patent. The result of this improvement taken with the improvement in the handle and panel assembly in a zipper closed portfolio as described in my co-pending application Ser. No. 06/859,483, filed May 5, 1986, entitled "Handle and Panel Assembly in Zipper Closed Portfolio" provides a leather lined portfolio having enhanced carrying capacity which is of improved strength.

BRIEF DESCRIPTION OF THE DRAWINGS

FIG. 8 is an enlarged fragmentary vertical sectional view, showing the portfolio open, taken on the line 8—8 of FIG. 1;

FIG. 8*a* is a fragmentary sectional view of the bottom of the portfolio, similar to FIG. 8, showing a modification of the reinforcing strap.

FIG. 9 is a fragmentary vertical sectional view through the mounting for the combination lock taken on the line 9—9 of FIG. 3;

FIG. 10 is an enlarged fragmentary vertical sectional view showing the seam and stitching construction at the bottom of the portfolio; and FIG. 11 is a modification, showing a handbag having an identification tag holder thereon.

DESCRIPTION OF THE PREFERRED EMBODIMENTS

Figure 1:
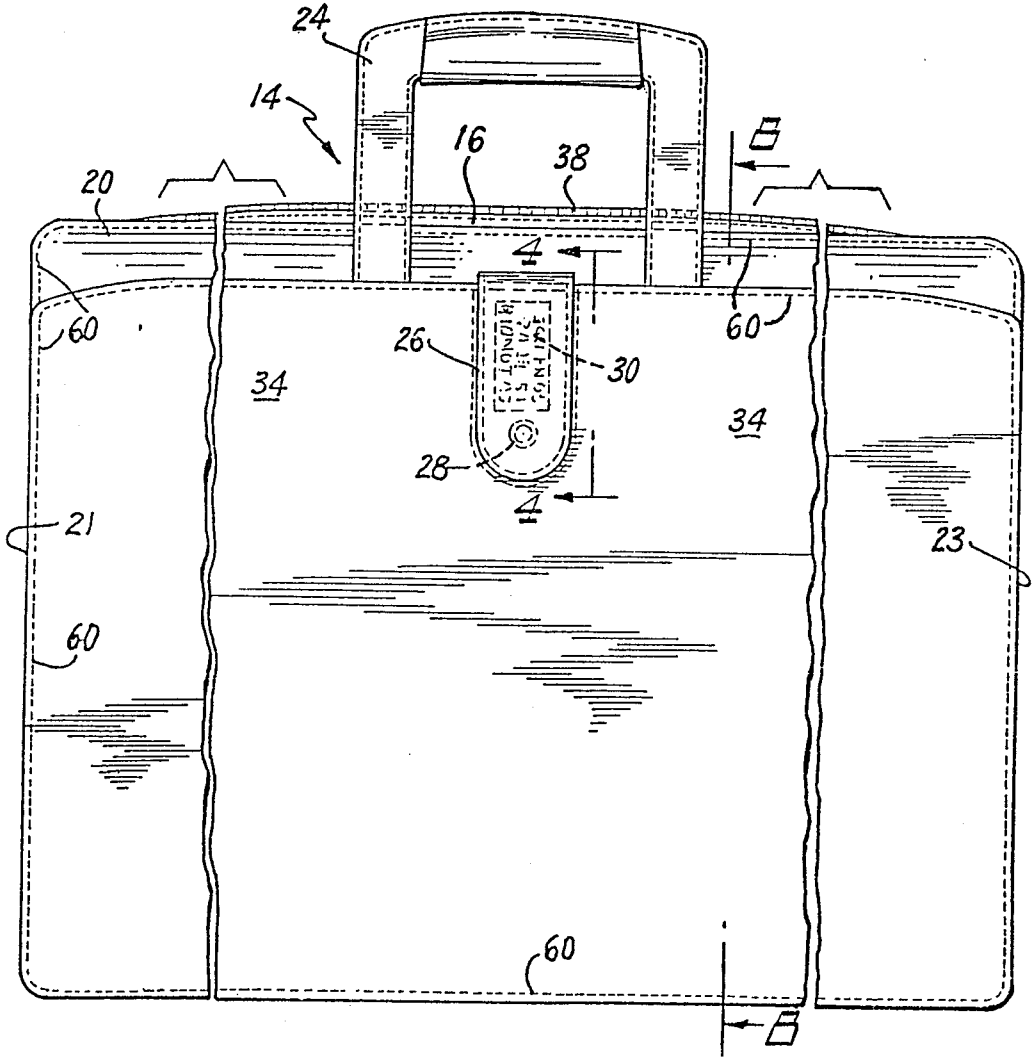
FIG. 1 is a fragmentary elevational view of the portfolio of the present invention.

The concealed name tag for portfolio 14 as shown in FIG. 1 and for handbag 114 as shown in FIG. 11 comprises a portfolio tab 26 which functions as the identification holder or as the tab 126 shown in FIG. 11 serving as the snap fastening identification holder for the pocketbook 114.

Figure 5:
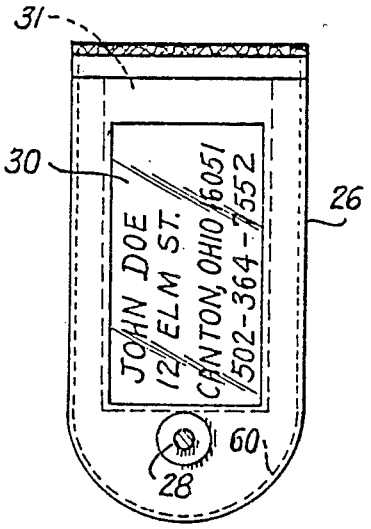
FIG. 5 is an elevational view, partly in section, of the identification tag holder, taken partly on line 5—5 of FIG. 4.

The interior of the tab 26 is provided with a pocket 31 as shown in FIG. 5 in cross-section in which an identification tag 30 and a snap fastener 28 is provided near the bottom of the rounded portion of the tab 26 to lock the tab with the identification concealed within the inner pocket. In the handbag 114 of FIG. 11 the inner pocket 120 is provided with the identification tag 130 having identification similar to that shown in FIG. 5 whereby the owner of the pocketbook or handbag 114 can establish ownership should the pocketbook be lost or mislaid.

In my co-pending application Ser. No. 06/859,483, filed May 5, 1986, entitled "Handle and Panel Assembly in Zipper Closed Portfolio, there is disclosed and claimed the novel improvement in a retractable handle wherein the inner seam which is formed on the lower inner edge of the handle between the front and back covers is normal as a hidden inseam and wherein the handle is improved by providing a pad below the separate wrap-around cover at the hand grip and then by securing the cover portions with an outer layer of stitching which passes through all of the cover layers and of the fiberboard reinforcement layer.

In my co-pending application Ser. No. 06/859,484, filed May 5, 1986, entitled "Hasp Lock, Zipper and Cover Assembly For Portfolio," the laminated outer leather sheet of the envelope portion of the portfolio is adhesively bonded to a synthetic foam liner to provide an improved construction having superior softness without the sacrifice of durability and of which a lock is embedded in the end of the portfolio, the handles being inverted U-shaped handles having a cross piece connected at the bottom and a zipper cover being provided for the center compartment. A combination lock is provided as part of the combination with the hasp and cover in order to complete a zipper operated center compartment adapted to be secured against unauthorized entry by means of the combination lock cooperating with the closing hasp.

The improvements in the present invention comprise the new sewing methods and novel structural features provided by these new methods which result in improved strength of the portfolio for the carrying of loads of paper contents and improved opening construction of the center compartment resulting from an entirely new sub-assembly of the new side pieces and the bottom piece of leather which are sewn together and reinforced by an outside strap of substantial thickness. Additionally, a new concealed identification tag is provided which has application to both portfolios and handbags of the center compartment type.

Figure 2:
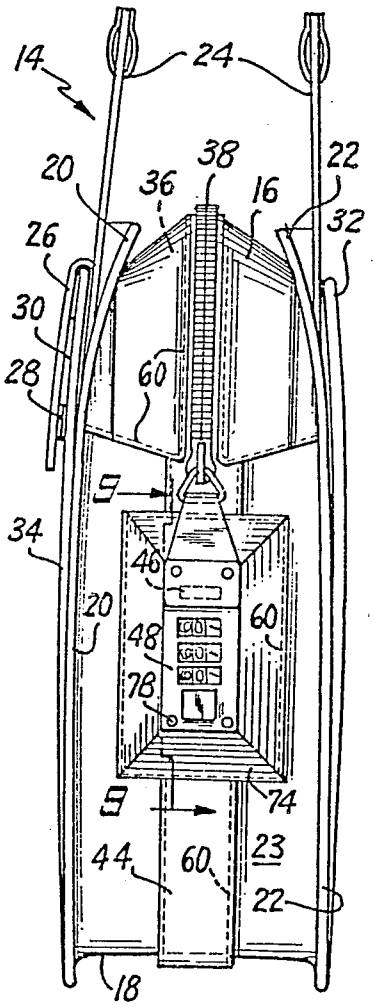
FIG. 2 is an end elevational view as viewed from the right of FIG. 1.
Figure 3:
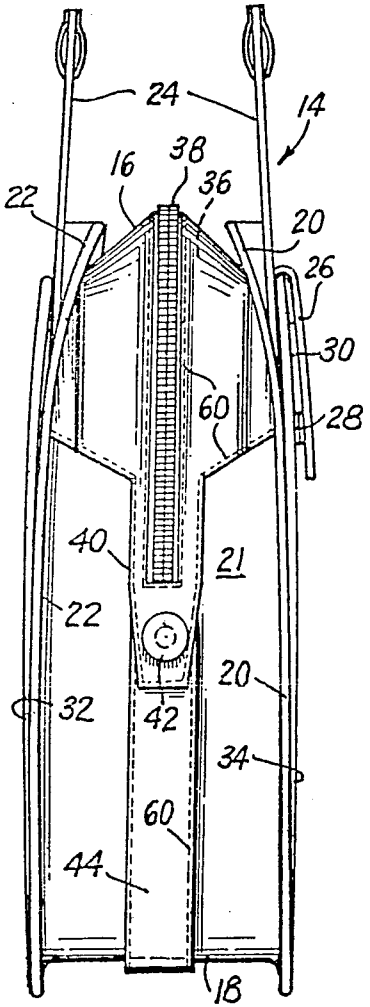
FIG. 3 is an end elevational view, as viewed from the left of FIG. 1.
Figure 4:
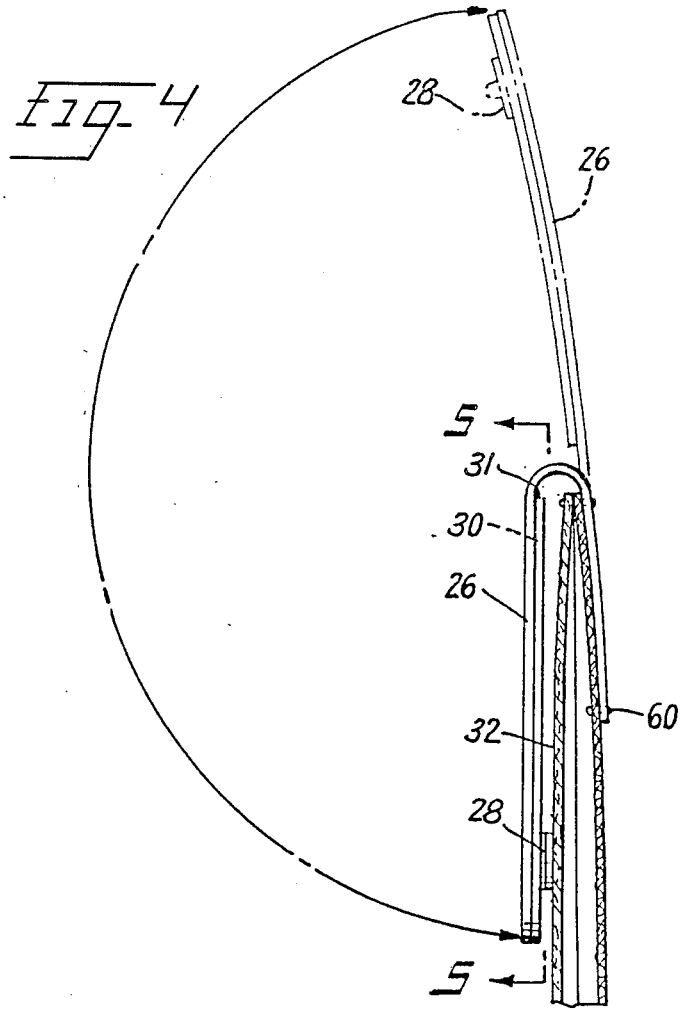
FIG. 4 is an enlarged fragmentary vertical sectional view, taken on the line 4—4 of FIG. 1.

In FIGS. 1-5, the hidden name tag 30 is shown on one side, the right side 22 of the portfolio 14 and is located at about a mid location relative to the handle 24 on the right side of the portfolio and so constructed and arranged to fold over the top edge at the middle and snap close by means of snap fastener 28 located near the bottom. As shown in FIGS. 2 and 3 which represent the locking end of the portfolio and the zipper starting side of the portfolio, the rectangular outer panels forming the left side 22 and the right side 20 provide the inner side walls for the right pocket 34 and the left pocket 32 in the portfolio 14 having the center compartment 36 which is fitted with the fastening means comprising zipper 35 extending over the top of the center compartment 36 and along the sides to terminate at snap fastener 42 as shown in FIG. 3 and in the locking position provided by the lock 48 with latch 36 as shown in FIG. 2. An identification tag 30 as shown in FIG. 5 bears the name and address of the owner and fits into a pocket 31 on the inside of closure flap 26 thereby constituting a concealed name tag for identification after the snap fastener is released and the inside of the closure flap 26 is exposed to view by lifting the flap to expose the name tag 30 for viewing.

The handle 24 and panel assembly consisting of the rectangular side panels 22 and 20 are essentially the same as those in my co-pending application Ser. No. 06/859,483, filed May 5, 1986, now U.S. Pat. No. 4,714,143, issued Dec. 22, 1987 and are not a feature of novelty of the present invention. The complete disclosure of the handle 24 in the side panels is described and claimed in my above-identified U.S. Pat. No. 4,714,143.

The portfolio 14 as shown in FIGS. 1, 2, 3 and 6 is manufactured by a novel process of manufacture to produce a novel center pocket 36 having a zipper covering sewn around the top 16 and upper right and left sides.

The novel center compartment 36 comprises a top 16 covering the top of the center compartment 36 and which is opened by operating the zipper pull 46 which is detached from the locking mechanism of the combination lock 48 to open zipper 38 and expose the entire contents of the center compartment 36. The tongue 40 is shown in FIG. 3 and which appears on the left side of the portfolio 14, is secured to the side of the portfolio 14, by means of snap fastener 42.

Figure 7:
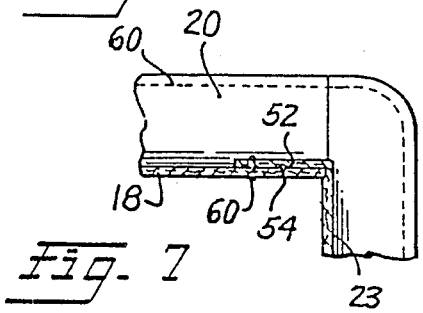
FIG. 7 is an enlarged fragmentary vertical sectional view, taken on the line 7—7 of FIG. 6.
Figure 6:
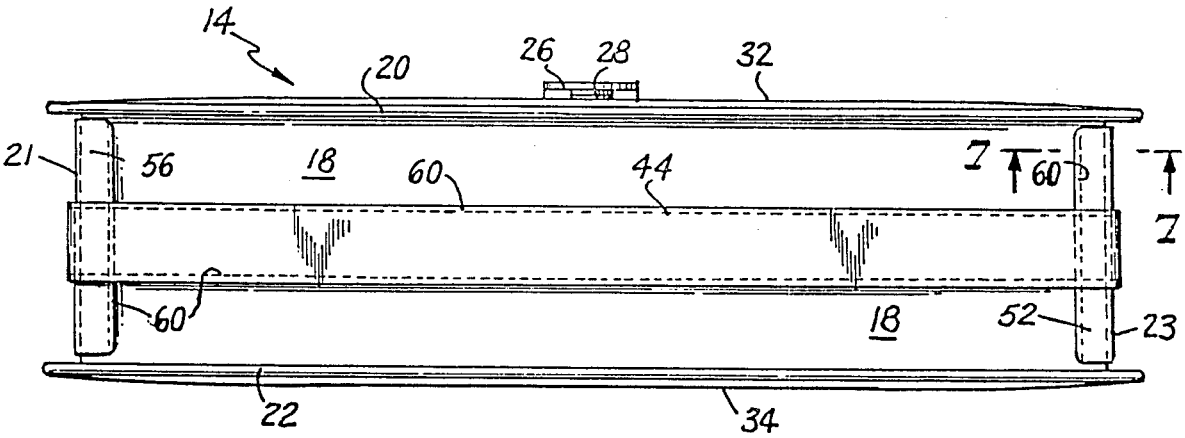
FIG. 6 is a bottom plan view of the portfolio of FIG. 1.

The zipper cover provided by sewing the top 16 to the inner top sides of the center compartment 22 on the right side and 20 on the left side is in general comparable to the sewing operation carried out in my companion co-pending patent application Ser. No. 06/859,484 filed May 5, 1986 entitled "Hasp Lock Zipper Cover Assembly for Portfolio" but an important distinction which provides a totally new and unobvious advantage over the zipper and cover assembly with lock in my co-pending application is based upon the combination of wider top dimension at the sides shown in FIG. 3 and reinforcing sewn strap consisting of reinforcing strap 44 which is sewn to the sides by stitching 60 at the edges of the strap and at both sides thereof. As shown in FIG. 8 the left side 21 of the portfolio is completely reinforced from the very top edge where the stitching line 60 runs parallel to the top edge and runs parallel to the sides at both edges of reinforcing strap 44 to continue around the bottom 18 of the portfolio and then around the side, right side 22 to the top which is correspondingly wider than at the bottom 18; The bottom of the portfolio 14 is shown in FIG. 6 and attention is directed to the edge underlapping portions 56 at the left side 21 and 52 at the right side 23. The edge portions 56 and 52 are folded under the bottom portions at the let and right side respectively and a line of stitching 60 is formed to provide a three-piece construction consisting of the two side pieces and bottom piece, respectively (see FIG. 7), with the side pieces being tucked around an inset from the left and right sides respectively 21 and 23. There is provided a unique stress relieving sewn construction by the continuous strap 44 at the bottom 18, and sides 21 and 23, due to the width of the reinforcing strap 44 is a significant proportion of the total width of the bottom 18 of the portfolio.

FIGS. 8 and 8A show different embodiments of the thickness of the reinforcing strap 44, the embodiment of reinforcing strap 44 having a thickness which is two to three times the thickness of the bottom portion 18 whereas the thickness of the reinforcing strap 44*a* shown in FIG. 8A is the same or substantially the same as the bottom 18.

As indicated in FIG. 8A the stitching 60 which joins the bottom 18 at the inner edge of the lining 50 through to the outer edge is the same in FIG. 8A as it is in FIG. 8. Also, the bottom insert 64 is in the same relationship in FIG. 8A with respect to the bottom 18 as in FIG. 8.

In a preferred embodiment as shown in FIG. 8 in which a thicker reinforcing strap 44 is sewn to the bottom 18 the portfolio 14 is provided with a leather lining 50 on the interior of the rectangular side panels 20 and 22. The provision of the lining 50 results in the attachment of the bottom 18 at the lower edges of the lining 50 at both right side 22 and left side 20 so that the bottom is stitched by the line of stitching 60 at each of these sides and as shown in FIG. 8. The sides 22 and 20 are provided with pockets 32 and 34 on the right side and the left side respectively as shown in FIGS. 2, 3 and 8 and the placement of the identification tag 30 beneath the handle 24 and over pocket 32 is shown in FIGS. 1 and 3.

In FIG. 8 the width of 44 is about 28% of the total width of the bottom 18 but this width may vary from about 20% to about 35%. It is of greater importance however that the thickness of reinforcing strap 44 be significantly greater than the thickness of the bottom 18 and the preferred thickness of the strap is about 150% to about 225%, good results being obtained with a thickness of about 125% and the thickness of greater than 225% being unnecessary. As a result of this reinforcement there have been no instances of failures by tearing away the stitching line 60 at the bottom 18 of the portfolio. Indeed the attempts made to strengthen the portfolio type luggage by producing special reinforced edge seams such as described in Holtzman, U.S. Pat. No. 3,866,554, granted Feb. 15, 1975, becomes entirely unnecessary. The simple provision of the reinforcing strap 44 in its width relation and thickness relation to the thickness of the bottom leather portion 18 provides unique advantages in the amount of papers which can be carried. The portfolio of the present invention can readily carry 8 pounds of papers in large 15 inch files in the center compartment and these are easily retrieved from the center portion because of the wide opening top, a top as shown in FIG. 8 which is wider by at least 20% than the bottom dimension at the sides. It is the unique advantage of the invention that high quality leather sides may be used and finished with high quality dyes to color the edges such as edge 70 in FIG. 10 in a darker color and yet be designed to carry loads which are not normally carried in soft side portfolio type luggage.

In FIGS. 2 and 9 the combination lock construction 48 is shown in which wood block 72 is provided as a support for the leather covering 74 which is stitched to the side wall 23 by means of stitching 60 which connects the covering 74 around the entire rectangular periphery of the covering to the side 23. The structure of the wood lock raises the lock mechanism 48 above the side 23 to permit the hasp 46 to engage the opening in the combination lock, this hasp serving as the locking element for the zipper and which extends from the opposite side 21 of the bag to the lock side of the bag 23. The construction of the hasp and the mounting of the lock and the relationship to the zipper cover are disclosed and claimed in my co-pending application Ser. No. 06/859,484, filed May 5, 1986, entitled "Hasp Lock, Zipper and Cover Assembly for Portfolio".

The other side of the zipper cover shown in FIG. 3 which shows the attachment of the zipper cover to side 21 comprises the tongue 40 extending below the widened portion of the zipper cover to the attachment fastener 42. The snap fastener may be a known magnetic type, as for example in the patent to Humiston, U.S. Pat. No. 3,324,521, granted June 13, 1967.

In FIGS. 8 and 10, the bottom construction of the center pocket of the portfolio is shown and attention is invited to the bottom insert 64 comprising fiberboard 66 which is stitched to the leather covering 68 and which serves as the bottom reinforcing member. The line of stitching 60 at the inner edges of the left side 20 and the right side 22 serves to penetrate the sides of the right pocket 32 and the left pocket 34 as well as the sides 22 and 20 respectively so that the subassembly of the bottom and trapezoidal shaped sides is externally reinforced throughout its side and bottom dimensions by the reinforcing strap 44.

The details of the concealed identification tag 30 in the preferred embodiment of FIGS. 1–5 as well as in the alternate embodiment of FIG. 11 in which the concealed identification tag bears reference numeral 130 can best be understood by the elements illustrated in FIG. 5, namely: the framing elements of the identification tag 30 shown on the right and left margins as longitudinal strip portions and the transverse strip portions comprising the portion along pocket 31 and the opposite transverse portion immediately adjacent to snap fastener 28. The framing elements which serve as a rectangular frame for the tag 30 are secured by stitching shown in dotted line extending along the bottom and upwardly along the sides of the identification tag which bears the legend of the name of the owner, the street address, city, state and zip code and a telephone number. The specific construction of stitching and pocket 31 and of the rounded bottom edge of the closure 26 where the snap fastener 28 is engaged is conventional, but what is not conventional is the specific manner of attachment of the end of the enclosure 26 remote from the snap fastener by stitching the opposite end of the closure 26 to the inner pocket below the top edge thereof which gives the appearance of a snap fastening closure rather than of an identifying tag for open viewing.

In the modification of the concealed identification tag shown in FIG. 11 the modification is illustrated in a handbag 114 which comprises a top 116, a bottom 118, a pocket 120, and a closure 126 which has a snap fastener 128 mounted adjacent the bottom edge and at a middle portion. The snap fastener 128 may be magnetic and be of the type shown in the Humiston patent. The inside flap of the closure 126 is provided with identification tag 130 on which the name, address and other identifying information is placed by the owner of the bag.

The handbag 114 in FIG. 11 as well as the portfolio 14 in FIG. 1 have the unique characteristic of identification tag concealed within the closure which is fastened on the inside of the envelope and on the outside of the center compartment of the portfolio or bag.

Having thus disclosed the invention, what is claimed is:

1. In a method of sewing a portfolio having generally rectangular left and right side panels, rectangular end panels between said left and right side panels, a rectangular bottom panel and a center compartment formed between said left and right side panels which is provided with fastening means for closing and opening said center compartment and locking means for securing the center compartment against unauthorized entry and taking of the contents, that improvement consisting of:

providing a unitary three part assembly of said rectangular bottom and the two rectangular end panels by sewing two end panels to the ends of the bottom panel;

the ends of said end panels which are sewn to said bottom panel extending inwardly from the corner formed when the end panels are erected for joining to the edges of said right and left side panels thereby providing a transverse joining seam which is inwardly displaced from the bottom corners of the portfolio;

the two rectangular end panels having a top width which is substantially greater than the bottom width in an amount of at least 10% and up to 25% wider at the top than at the bottom;

sewing a reinforcing strip to the outside of said end panels extending from the top of said end panels along the bottom whereby said reinforcement strip along the bottom extends to the top ends of the portfolio; and said reinforcing strip having at least the thickness of said bottom and end panels and being up to about two and one-half times as thick and being located at the center of said ends and sides to take up a distance of at least about 10% up to 35% of the width of the bottom and ends thereby providing an outer reinforcement of said sides and bottom, and sewing said three part assembly of ends and bottom to the left and right side panels of the portfolio to provide a strengthened bottom and wide opening top.

2. A method as claimed in claim 1 wherein said reinforcing strip is about 30% of the width of said bottom and said ends of said three part assembly and is stitched along each longitudinal edge.

3. A method as claimed in claim 2 wherein said reinforcing strip has a thickness of about 100% to 125% of the thickness of said bottom and ends.

4. A method of sewing a portfolio and reinforcing the bottom of said portfolio as claimed in claim 1 comprising providing a fiberboard rectangular support panel within the center compartment and at the bottom to support the contents of the center compartment, said fiberboard panel serving to support the weight of papers placed in said center compartment and facilitate more easily introducing and receiving files and other papers in said center compartment.

5. A method as claimed in claim 1 comprising the additional step of sewing a unitary assembly of zipper, zipper end fastener, zipper cover and lock hasp to the top of the center compartment of the portfolio along the inner upper edges of the right panel and the left panel and of embedding a lock at the end of the portfolio which is remote from the zipper end fastener whereby the lock hasp engages the lock when the zipper is closed.

6. A method as claimed in claim 5 wherein said zipper end fastener remote from said lock comprises a snap fastener which engages a fastening element in said reinforcing strip which lies directly below said zipper end fastener.

* * * * *